United States Patent [19]

Thompson et al.

[11] 4,031,872

[45] June 28, 1977

[54] THERMOSTATIC AUTOMATIC CHOKE CONTROL FOR SMALL ENGINES

[75] Inventors: Robert G. Thompson, Milwaukee; Heinz K. Gund, Brookfield, both of Wis.

[73] Assignee: Briggs & Stratton Corporation, Wauwatosa, Wis.

[22] Filed: Sept. 19, 1975

[21] Appl. No.: 614,891

Related U.S. Application Data

[60] Continuation-in-part of Ser. No. 516,641, Oct. 21, 1974, abandoned, which is a division of Ser. No. 417,402, Nov. 19, 1973, Pat. No. 3,863,614.

[52] U.S. Cl. ..... 123/119 F; 261/39 B; 261/39 R

[51] Int. Cl.[2] ..... F02B 33/00

[58] Field of Search ..... 123/119 F; 261/39 R, 261/39 B

[56] References Cited

UNITED STATES PATENTS

| | | | |
|---|---|---|---|
| 2,548,334 | 4/1951 | Armstrong | 123/119 F |
| 2,939,445 | 6/1960 | Sterner | 123/119 F |
| 2,956,558 | 10/1960 | Sterner | 123/119 F |
| 3,248,094 | 4/1966 | Ball | 123/119 F |
| 3,248,675 | 4/1966 | Furbacher | 123/119 F |
| 3,789,814 | 2/1974 | Gillham | 123/119 F |
| 3,863,614 | 2/1975 | Thompson | 123/119 F |

*Primary Examiner*—Carroll B. Dority, Jr.
*Assistant Examiner*—Daniel J. O'Connor
*Attorney, Agent, or Firm*—Ira Milton Jones & Associates

[57] ABSTRACT

The choke valve of a small engine, biased towards a closed position, is link connected with an air vane that tends to open it under force of cooling air blown across the engine. The air vane has a lost motion connection with a control shaft that is rotatable between defined hot and cold positions. Shaft position is established by two spirally coiled bi-metal thermostats, one for high temperatures, one for low temperatures, each in a unidirectional torque transmitting connection between the shaft and fixed structure whereby each thermostat imposes force upon the shaft only at temperatures within its own range.

10 Claims, 12 Drawing Figures

44
43
21
28
24
22
48
23
29
25
46
47
30
32
31
33
40
34

Fig. 10
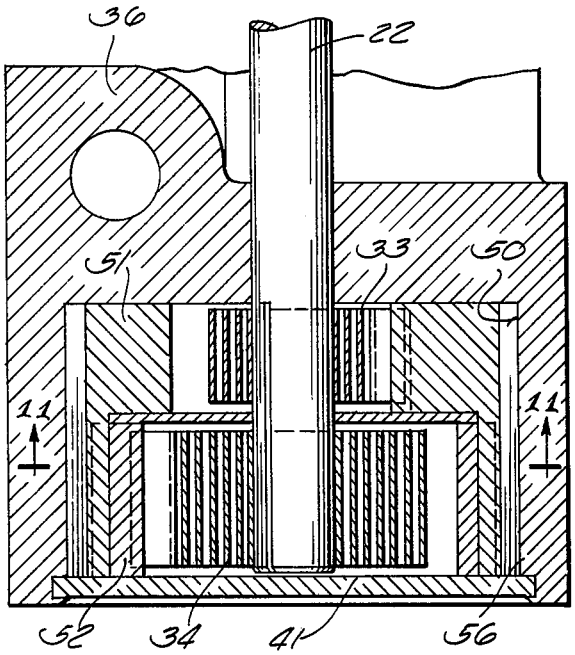
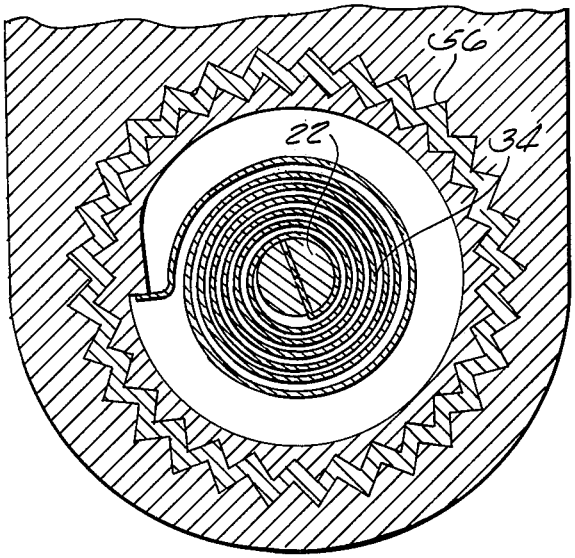
Fig. 11
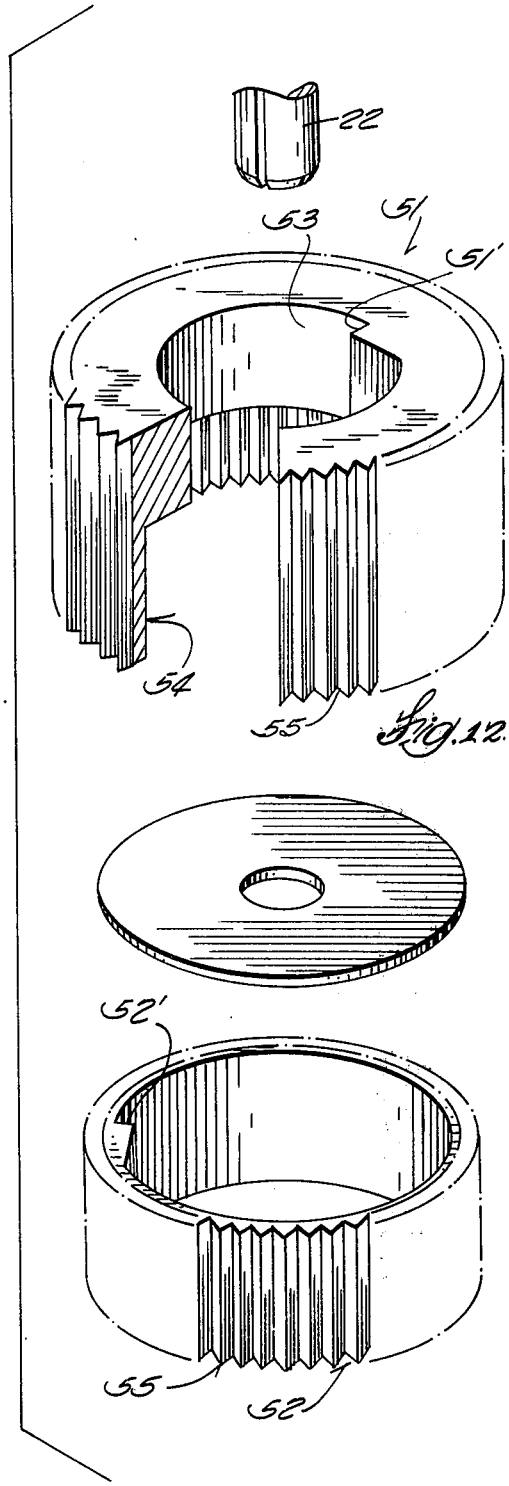
Fig. 12

THERMOSTATIC AUTOMATIC CHOKE CONTROL FOR SMALL ENGINES

This application is a continuation-in-part of the abandoned application Ser. No. 516,641 filed Oct. 21, 1974, which was a division of application Ser. No. 417,402 filed Nov. 19, 1973, now U.S. Pat. No. 3,863,614.

This invention, like that of said allowed application and said patent, relates to bi-metal thermostatic devices, and is especially concerned with a bi-metal thermostatic device suitable for use as an automatic control for the carburetor choke valve of small single-cylinder air-cooled internal combustion engines. The invention is thus classifiable with that of the W. E. Armstrong Pat. No. 2,548,334 issued Apr. 10, 1951.

In the automatic choke control devices of both the Armstrong patent and the present invention, a choke valve is biased towards its closed position and can be swung towards its open position by means of an air vane which is responsive to the stream of engine cooling air that is generated by a blower flywheel on the engine. Swinging of the air vane, and hence of the choke valve, is controlled by a thermostat which has a lost motion connection with the air vane and which is located to be influenced by the heat of the engine.

However, as distinguished from the automatic choke control of the Armstrong patent, the present invention achieves its objectives with a more simple and more compact structure.

A characterizing feature of the structure of the present invention resides in location of the air vane and the thermostat at opposite end portions of a single rotatably mounted control shaft. The thermostat is seated in a well formed in the cylinder casting, closely adjacent to the engine exhaust port, where the influence of engine heat upon it is assured. The air vane is in the stream of cooling air generated by the conventional blower flywheel on the engine, under the shroud that guides the cooling air across the cylinder body. The control shaft, which comprises a lost motion connection between the thermostat and the air vane, is likewise in an out-of-the way location, most of it being under the blower shroud.

But the main advantage which the automatic choke control of this invention possesses over its predecessor is its ability to provide much more reliable and accurate choke valve positioning throughout a substantially wide range of ambient and engine temperature conditions.

The conventional thermostat heretofore employed in automatic choke control devices comprised a flat bimetal strip that was coiled into a spiral or a helix. One end of the strip was confined against motion; its other end was attached to a rotatable control member. When the thermostat was subjected to a changing temperature, the control member was rotated in a direction that depended upon whether the temperature change caused the bi-metal strip to expand and unwind or to contract and curl up.

When an internal combustion engine is running and fully warmed up, its automatic choke control thermostat is subjected to a temperature in excess of 400° F. In a cold engine the thermostat is of course at ambient temperature, which can be anywhere within the range of, say, 20° F. below zero to 80° F. or more above zero. This means that for choke control that will afford easy starting under all expectable weather conditions, a thermostat that cooperates with an air vane choke actuator must be capable of fully withstanding the choke opening force exerted by the actuator at the lowest expectable ambient temperature but must permit the choke actuator to take over and swing the choke open little by little as the engine temperature rises through the high ambient range and towards the hot engine temperature. However, when a fully warmed-up engine is stopped, the thermostat must hold the choke valve slightly open, against the constantly applied biasing force that tends to swing it closed, for otherwise immediate restarting would be very difficult. Therefore the thermostat means of an automatic choke control device must not only be effective through one temperature range, to control choke opening, but must also be effective in another and substantially higher temperature range to prevent choke closing.

However, the torque force exerted by a coiled bimetal strip varies with temperature at a rate that is (for all practical purposes) uniform throughout its range of response. Since the total rotation to be imparted to a choke valve, for swinging it between its fully open and its fully closed positions, is about 90°, the control member that is rotated by a choke control thermostat must be confined to rotation through only a relatively limited angle. The control member must be brought to its high temperature limit of rotation before the engine is fully warmed up, and it must remain in that same rotational position as the engine temperature continues to rise to the fully warmed-up value. Hence, once the control member has reached its high temperature limit of rotation, a single coiled bi-metal thermostat like that of the Armstrong patent develops increasing stress with increasing engine temperature.

If it is to provide effective control of choke opening, and especially if it is to afford control that will make for easy starting at very low ambient temperatures, a bimetal thermostat must comprise a relatively long strip that is coiled into relatively numerous convolutions. In an arrangement like that of the Armstrong patent, the stresses developed in such a strip when the engine comes up to its normal high operating temperature can be great enough to deform it permanently. Once so deformed, the thermostat is of course no longer effective for cold weather starting. With the prior arrangement, the only alternative to risking such deformation of the thermostat was to provide a thermostat that inherently made for poor starting in very cold weather.

This dilemma was in itself sufficient to discourage installation of the choke control of the Armstrong patent on engines that would have to be started in extremely cold weather. But devising an escape from the dilemma was complicated by certain requirements which are imposed by the small engines for which such choke control devices are intended. Every part of a small engine must be extremely compact but sturdy enough to withstand very adverse conditions, and even outright abuse. To add to the difficulties, intense competition in the small engine industry mandates that costs be kept to rock-bottom minimums.

With the foregoing considerations in mind it is a general object of this invention to provide a thermostatic device for automatic choke control that is effective to afford the desired choke valve positioning through the greatest expectable range of ambient temperatures and up to the highest normal engine operating temperatures, without any tendency to be overstressed at either temperature extreme to which it may be subjected; and, moreover, to provide such a thermostatic device that is well suited for small engines by reason of its capability for cooperation with an air vane choke actuator and its compactness, sturdiness and low cost.

From a practical standpoint, therefore, it is an object of this invention to provide a compact, inexpensive, sturdy and reliable automatic choke control for small internal combustion engines that enables an engine on which it is installed to be started easily and promptly in temperatures as low as twenty degrees below zero (Fahrenheit) and also to be readily restarted while hot.

Another object of the invention is to provide such an automatic choke control device which can be readily adjusted by factory and service personnel but which has its relatively delicate thermostat means inaccessible to tampering.

It is also an object of this invention to provide a thermostatic device of generally utility, comprising a member which is confined to motion between one limit at which the member is maintained through one range of temperatures and an opposite limit at which it is maintained through another and substantially different range of temperatures, and bimetal strip means so connected with the movable member as to maintain it properly positioned for prevailing temperatures without risk that the bimetal strip means will be subjected to stresses high enough for permanent deformation.

Still another object of this invention is to provide an automatic choke control which can be easily adapted to different carburetor types, as for instance, the updraft carburetors used on engines such as the one illustrated in the Armstrong patent and the horizontal draft type used on engines such as that of the Lechtenberg et al U.S. Pat. No. Des. 173,072, wherein the fuel is more easily drawn into the cylinder so that less choking is needed.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 10 is similar to the lower right-hand portion of FIG. 4, but illustrates a modification of a portion of the control device which permits the same to be adjusted to different requirements;

FIG. 11 is a cross sectional view through FIG. 10 on the plane of the line 11—11; and FIG. 12 is an exploded perspective view of parts of the structure shown in FIG. 10.

Figure 1:
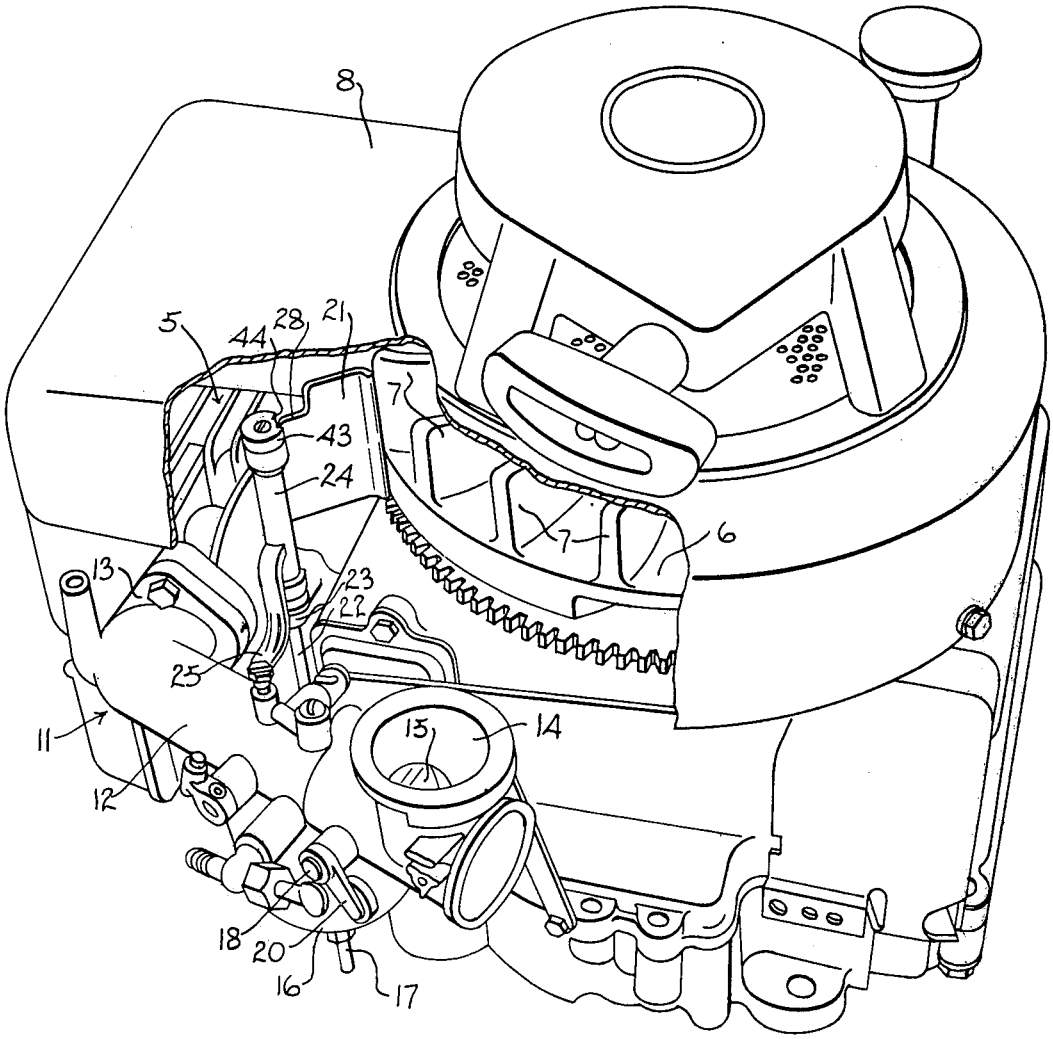
FIG. 1 is a perspective view of a vertical crankshaft engine like that of the aforesaid Lechtenberg et al design patent, equipped with the automatic choke control of this invention, a part of the blower housing being shown broken away and the muffler and the air cleaner being omitted from the view.
Figure 2:
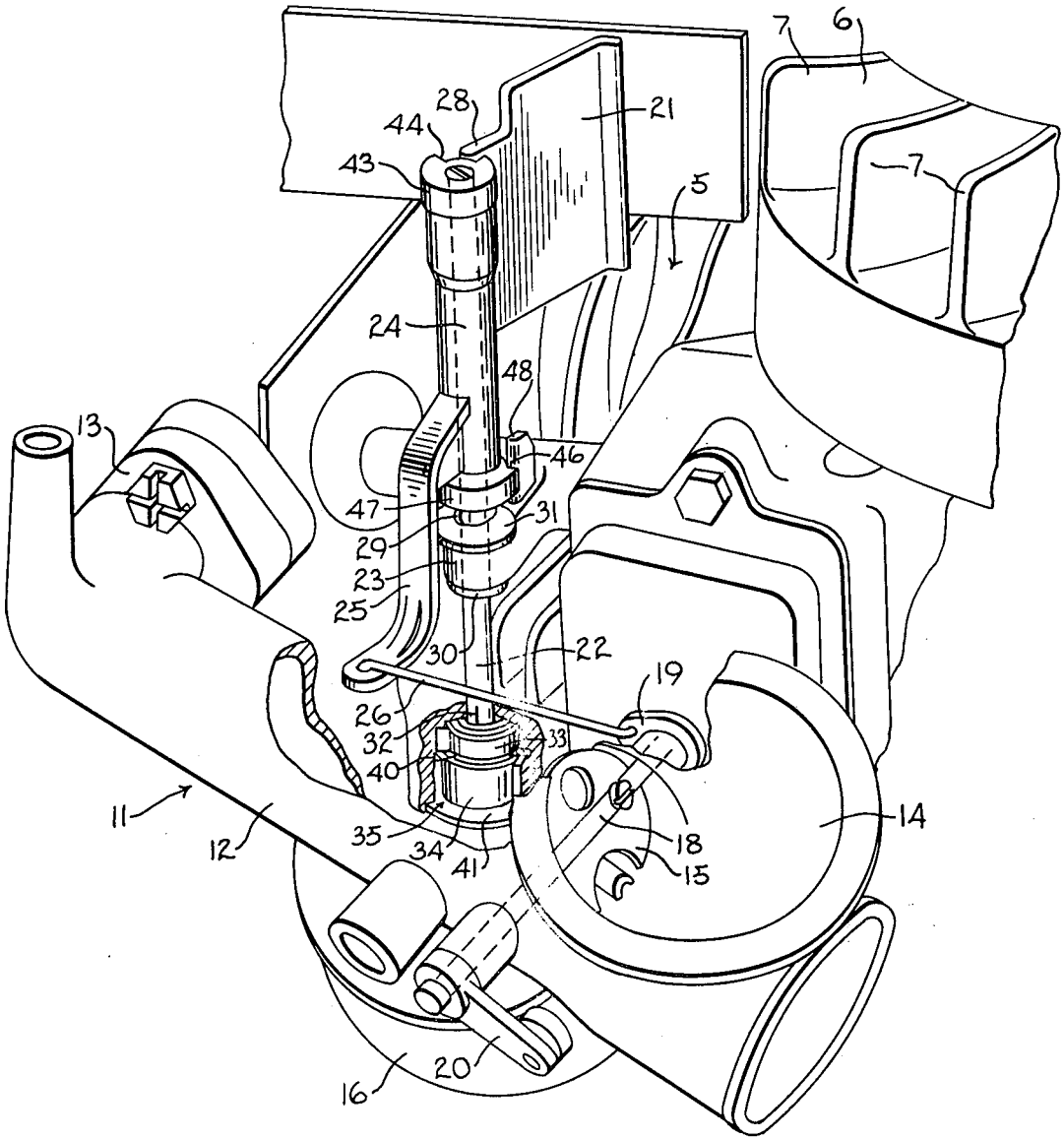
FIG. 2 is a perspective view of the choke control in its relation to adjacent portions of the engine and carburetor.
Figure 3:
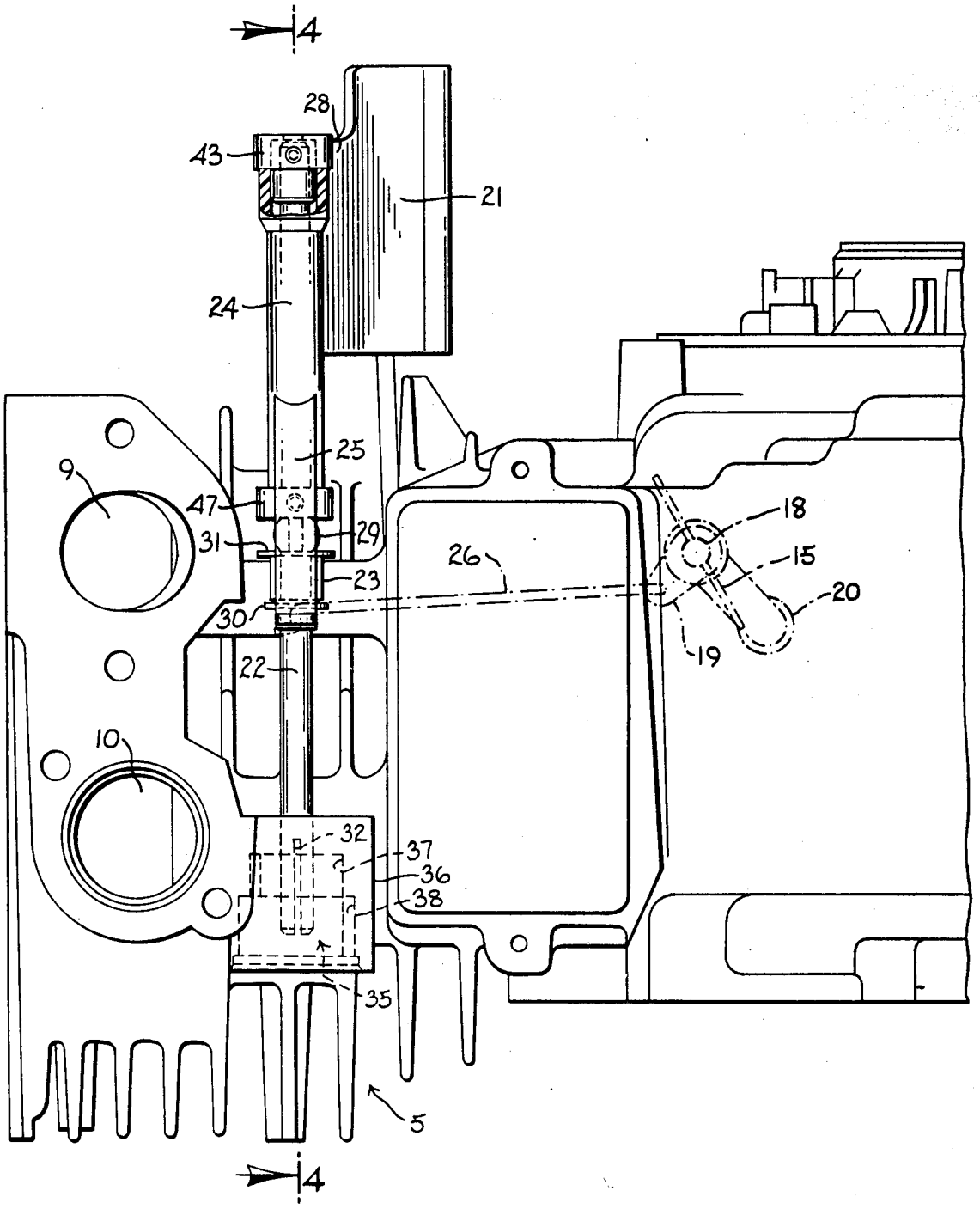
FIG. 3 is a side view of the engine cylinder casting per se, with the choke control assembled thereon and the choke valve shown in broken lines.

Referring now to the drawings, the numeral 5 designates the cylinder casting of a wellknown single cylinder air cooled engine of the vertical crankshaft type. The crankshaft of the engine has a flywheel 6 mounted on its upper end portion. As is customary, impeller vanes 7 formed on the flywheel induce a flow of cooling air through a blower housing 8 and over the hot surfaces of the engine.

The cylinder casting has the usual intake and exhaust ports 9 and 10, respectively, the latter being threaded to provide for the attachment of a muffler (not shown) and the former receiving the fuel mixture delivered to the engine by its carburetor, which is generally designated by the numeral 11. The carburetor has an elongated tubular body 12 with flanges 13 at one end thereof which are bolted to the cylinder casting to mount the carburetor. The opposite end of the tubular carburetor body is formed to provide an upwardly facing air inlet port 14 onto which an air cleaner (not shown) is attached. The interior of the tubular carburetor body, between the air inlet port and its discharge end, comprises a mixing passage in which there are the customary venturi and throttle valve, neither of which is shown; and between the throttle valve and the air inlet port is the choke valve 15 of the carburetor, which of course serves to regulate the admission of air into the mixing passage.

Fuel enters the mixing passage from a float bowl 16 at the underside of the tubular body that has a fuel inlet fitting 17 to which a fuel supply line (not shown) connects.

The choke valve 15 is of the butterfly type and hence comprises a disc fixed to a shaft 18 that is journaled in coaxial bores in diametrically opposite side walls of the tubular body, the axis of the shaft being horizontal. For imparting choke valve actuating rotation to the shaft 18, an actuating lever 19 is fixed to its end adjacent to the cylinder casting, and at its other end a weighted lever 20 is fixed to the shaft to bias the choke valve towards a defined closed position.

When the engine is running, the choke valve tends to be opened by an actuator comprising an air vane 21, under the force exerted upon the air vane by the stream of engine cooling air flowing through the blower housing. Thus choke valve opening force is derived in the same way as in the aforesaid Armstrong patent; but instead of the air vane being directly mounted on the choke valve shaft, as it is in the Armstrong patent, the vane 21 is freely rotatably mounted on a vertical control shaft 22 that is in turn rotatably journaled in a bearing boss 23 on the cylinder casting. To enable the vane to swing freely on the control shaft 22, the vane is part of a plastic molding which comprises a choke valve actuator and which has an elongated hub 24 wherein the upper portion of the shaft 22 is received. The vane 21 projects radially from the upper portion of the hub 24. The choke valve actuator also comprises a radially projecting arm on the lower portion of the hub that has its extremity connected by means of a link 26 with the actuating lever 19 on the choke valve shaft. The choke valve and the air vane are thus directly linked, so that the choke valve is constrained to swing in correspondence with rotation of the air vane about the axis of the shaft 22.

It will be apparent that when the engine is not running and the bias provided by the weighted lever arm 20 is not restrained, the choke valve will be in its defined closed position and the air vane will occupy a position extending across the path of the stream of engine cooling air that flows through the blower housing when the engine is in operation.

Figure 4:
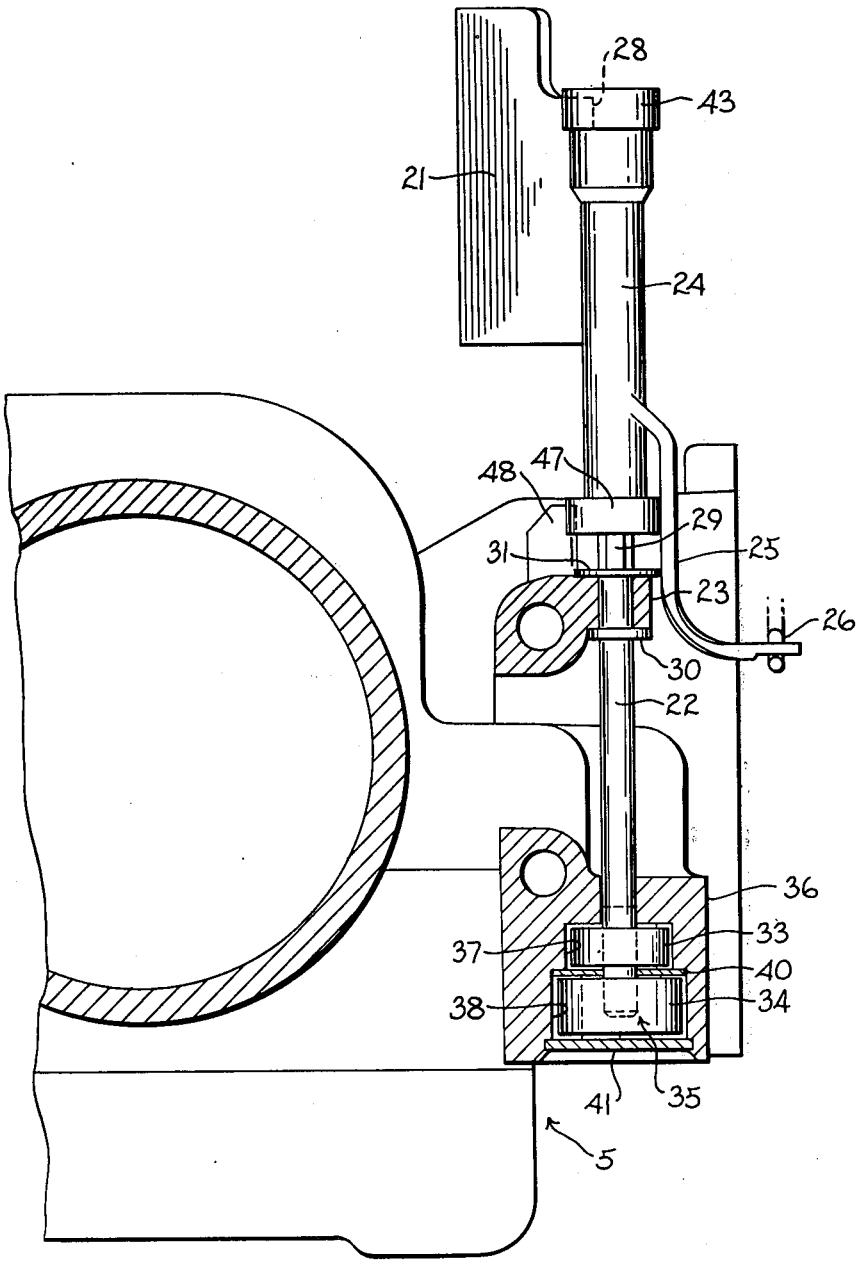
FIG. 4 is a sectional view taken on the plane of the line 4—4 in FIG. 3.
Figure 5:
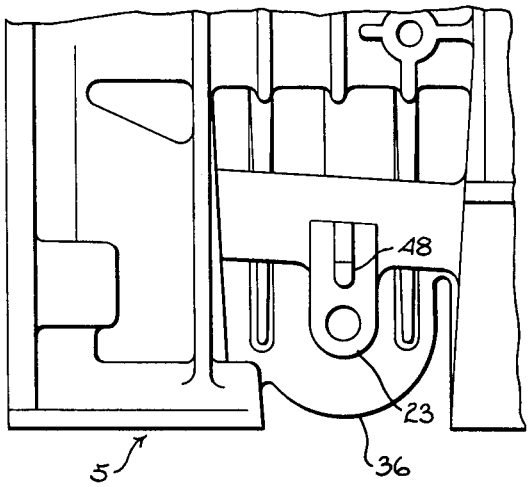
FIG. 5 is a fragmentary top view of that portion of the cylinder casting on which the choke control is mounted.
Figure 7:
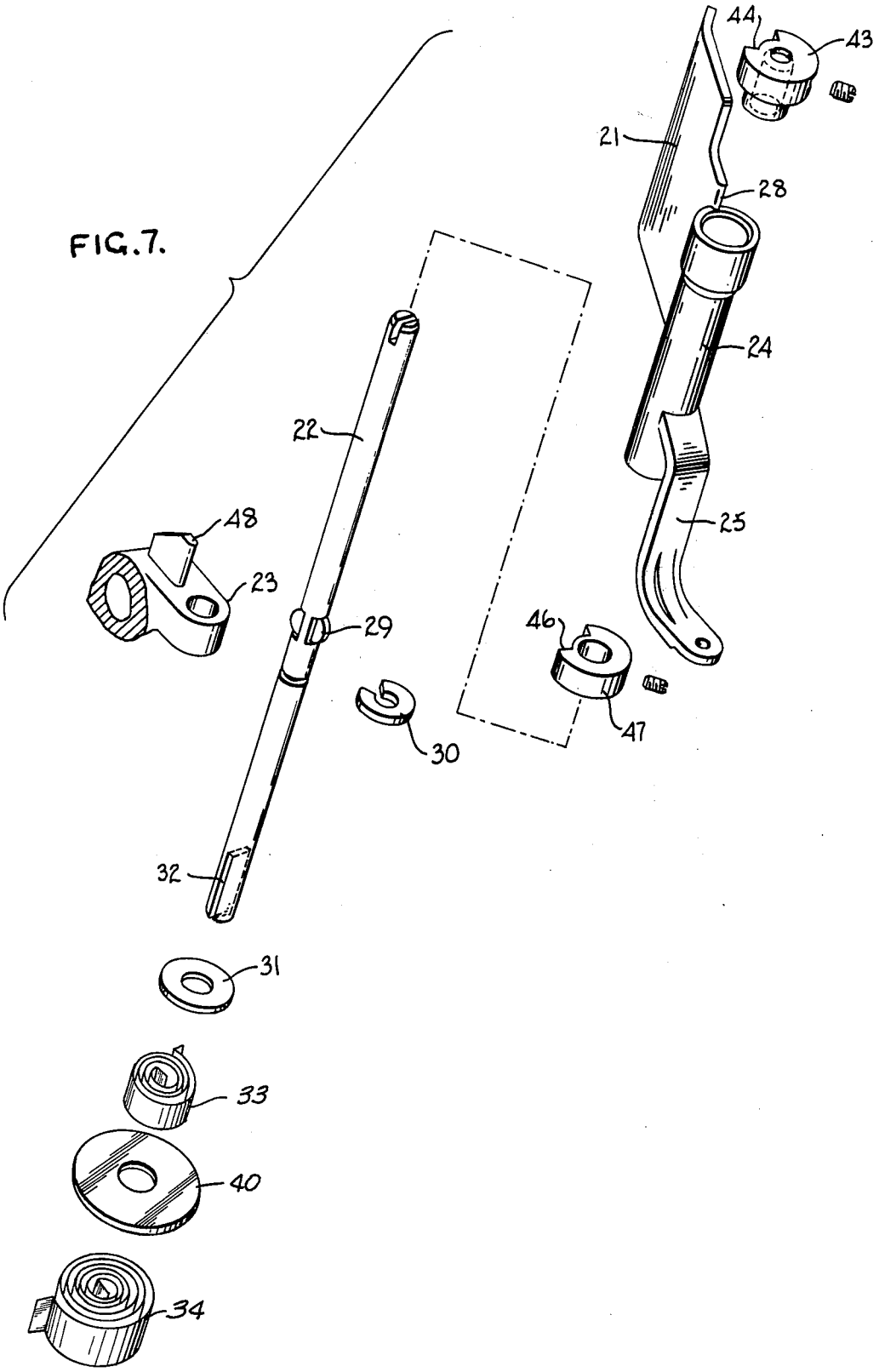
FIG. 7 is an exploded perspective view of the several parts of the control.

In best seen in FIGS. 4 and 7, there are abutments 29 and 30 on the control shaft 22, directly above and beneath the boss 23, which cooperate with that boss to confine the shaft against axial displacement without interfering with its free rotation. The lower abutment 30 is provided by a C-washer snapped into a groove in the shaft directly below the underside of the boss, and the upper abutment 29 comprises a pair of diametrically opposite swaged ears projecting from the shaft and seated on a washer 31 that is interposed between those ears and the boss 23.

The control shaft 22 has a transverse slit 32, opening to its bottom end and somewhat elongated axially, to provide for its attachment to a pair of spirally coiled bi-metal strips 33 and 34. These bi-metal coils comprise the thermostatic control means of this invention that governs the response of the choke valve to the opening force produced by the air vane actuator. To perform their function, the thermostats must be so located as to be sensitive to the heat of the engine in operation. This objective is most effectively achieved with the present invention by locating the thermostats and the lower slitted end portion of the shaft 22 in a cavity 35 formed in a lug 36 that is in close juxtaposition to the exhaust port 10. The lug 36 can comprise a separate part suitably secured to the cylinder casting, but it is preferably formed integrally with that casting, as shown.

The cavity 35 is a two-diameter cylindrical well which opens to the underside of the lug 36 and which is coaxial with the bore through the lug 23 that constrains the shaft 22 to rotation. In the end wall of the cylindrical well there is a hole which is concentric with the cavity and through which the control shaft 22 projects into the cavity with a close but freely rotatable fit. The axially innermost small diameter upper portion 37 of the cylindrical well is axially shorter than the large diameter lower portion 38 thereof. The bi-metal coil 33, which is the smaller of the two and can be considered a hot thermostat, is received in the upper portion 37 of the cylindrical cavity; the cold thermostat 34 is received in the larger lower portion of the cavity.

The mouth of the cylindrical well or cavity 35 is closed by a Welsh plug 41, to preclude tampering with the bi-metal elements.

The inner convolutions of the bi-metal coils have radially in-turned end portions that are seated in the slit 32 in the control shaft 22, so that as the coils wind and unwind they can impart torque to the control shaft.

Figure 6:
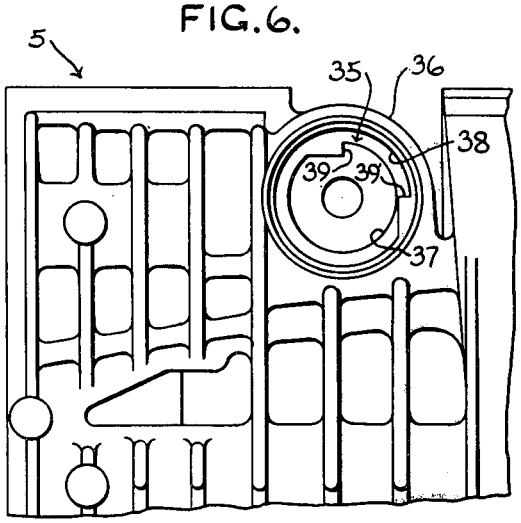
FIG. 6 is a fragmentary bottom view of that portion of the cylinder casting on which the choke control is mounted.
Figure 8:
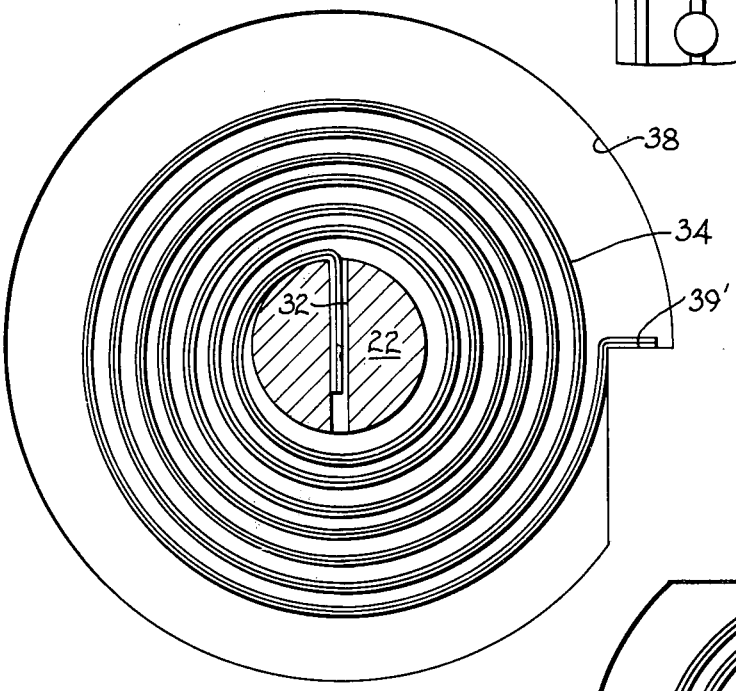
FIGS. 8 and 9 are diagrammatic views illustrating the manner in which the two oppositely acting thermostats function to control choke valve position.
Figure 9:
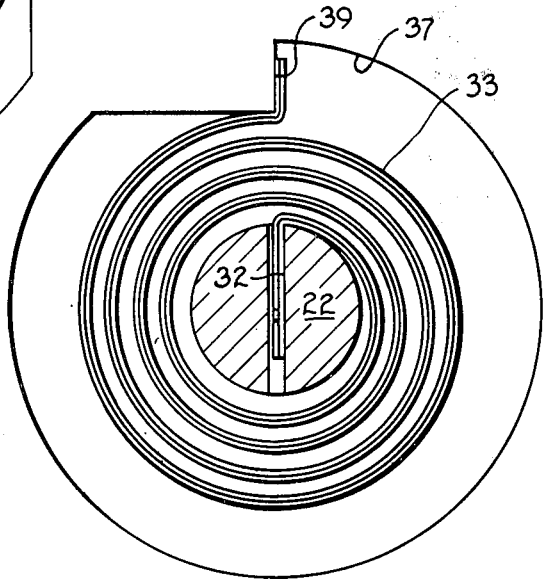

As best seen in FIGS. 6, 8 and 9, the well portions 37 and 38 are formed with shoulders 39 and 39' respectively, that project radially inwardly from their cylindrical side walls. These shoulders provide stops against which radially out-turned end portions of the outer convolutions of the two spirally coiled bimetal strips 33, 34 can abut and react as the coils wind and unwind in response to temperature changes. It is to be observed, however, that the shoulders 39, 39' provide unidirectional connections between the bi-metal strips and the fixed structure comprising the lug 36, so that each of the thermostats can impose torque upon the control shaft 22 in only one direction of its rotation. The shoulders 39, 39' face in opposite directions, and the two bi-metal elements are oppositely coiled and also have their higher coefficients of expansion at opposite faces. Hence, as explained hereinafter, the bi-metal coils alternate with one another in controlling the rotational orientation of the control shaft 22.

To guard against interference between the coils of the superimposed bi-metal elements, a washer 40 is interposed between them.

As noted hereinbefore, the choke valve is constrained to move with the choke valve actuator that comprises the air vane 21 and its hub 24, but the choke valve actuator is free to turn with respect to the shaft 22 to which the thermostats are connected. To enable the thermostats to limit opening of the choke valve in response to the opening force exerted upon the air vane by the stream of cooling air that impinges it, there is a lost motion connection between the control shaft 22 and the choke valve actuator. One element of the lost motion connection comprises a finger 28 which is formed integrally with the plastic molding and which projects radially inwardly from the air vane across the top of its hub 24. The other element of the lost motion connection comprises an angularly slotted collar 43 which is angularly adjustably fixed to the upper end portion of the control shaft 22 and which overlies the upper end of the hub portion 24. An angular slot 44 in the peripheral portion of the collar 43 accommodates the fin or finger 28.

As will be readily understood, the circumferential length of the slot 44 determines the extent of rotary lost motion between the air vane and the control shaft 22, and the angular position of the collar 43 on the shaft 22 determines the relationship of the lost motion with respect to the effect of the thermostatic elements upon the shaft position.

The angle through which the control shaft 22 can turn in response to the balance of the several torque producing forces exerted upon it by the air vane actuator, the weighted arm 20 and the thermostatic elements is limited by a second circumferentially slotted collar 47, adjustably fixed to the shaft 22 beneath the hub porton 24 of the air vane unit and just above the swaged ears 29. To define the limits of rotation of the control shaft 22, the ends of an arcuate slot 46 in the collar 47 collide with a stop fin 48 that projects from the top of the boss 23.

It will be apparent that rotational adjustment of the collar 47 on the control shaft 22 establishes the temperature range at which that shaft tends to be maintained at each of its limits of rotation. The adjustability of that collar thus enables the automatic choke control device of this invention to be readily adapted for installation on different types of carburetors, as for example updraft carburetors which require relatively heavy choking and horizontal draft carburetors which require less choking. Rotational adjustment of the collar 43 on the control shaft enables the automatic choke device to be readily mated with any particular linkage between a choke actuator and a choke valve.

Since the hub portion 24 of the plastic molding is axially confined between the collars 43 and 47, both of which are fixed to the shaft 22, those collars confine the plastic molding to rotation relative to the control shaft.

Returning now to a consideration of the thermostats 33 and 34 and the manner in which they cooperate with one another, the bi-metal strip comprising the cold thermostat is coiled in the direction to have its surface with the larger coefficient of expansion radially outermost so that the cold thermostat contracts and curls up with increasing temperatures. The hot thermostat strip is coiled in the opposite direction so that upon heating it expands and unwinds. The shoulders 39, 39' face in opposite circumferential directions such that each shoulder takes the reaction to unwinding or expansion of the bi-metal coil with which it cooperates.

As seen in FIGS. 8 and 9, the control shaft 22 rotates clockwise towards its high temperature range rotational position, at which it permits full opening of the choke valve.

When the engine is cold, the larger cold coil 33 reacts between its shoulder 39' and the control shaft to urge the control shaft towards its low temperature range position at which the air vane choke actuator is inhibited from opening the choke valve. At very cold ambient temperatures the cold coil 33 exerts sufficient torque force upon the control shaft 22 to substantially prevent movement of the choke actuator and thus hold the choke closed or nearly closed even when the engine is running. As temperatures increase from the very cold ambient level, the cold coil gradually contracts and winds up, decreasing its torque force upon the control shaft and thus allowing the air vane actuator to take over and swing the choke valve towards its open position in step with the rising temperatures. As the temperature rises above the highest level at which the choke valve should be restrained against fully opening, the cold coil curls or winds up enough to disengage itself from its shoulder 39', so that the cold coil is not subjected to any externally imposed stress at such high temperatures.

Meanwhile, the hot coil 33 is functioning in a manner opposite to the operation of the cold coil, inasmuch as it unwinds or tends to straighten out upon heating and exerts torque force upon the control shaft 22 only at high temperatures. Thus, when the engine is hot, the hot coil holds the control shaft 22 at its high temperature position of rotation. The choke valve is then held slightly open when the engine is stopped and can be fully opened by the air vane actuator as soon as the engine begins to run. At lower temperatures the cold coil controls the rotational position of the shaft 22, and the hot coil is disengaged from its shoulder 39 so as not to be subjected to any externally imposed stress.

It will be apparent that each bi-metal coil is subjected to only a limited externally imposed stress, not high enough to permanently deform it, owing to the fact that each coil exerts torque upon the control shaft 22 through only a relatively narrow range of temperatures.

Merely for the sake of illustration, the small hot thermostat 33 can consist of about four turns of one-quarter inch wide bi-metal strip, and the larger cold thermostat 34 can comprise seven turns of three-eights inch wide bi-metal strip.

As will be evident from what has been said with respect to the shoulders 39 and 39' and the fact that they coact with the out-turned end portions of the outer convolutions of the two spirally coiled bi-metal thermostats 33 and 34 to provide oppositely facing unidirectional force resisting connections between the ends of the outer convolutions and the fixed structure in which the control shaft 22 is mounted, the locations of these shoulders has a significant bearing upon the results obtained with the control device. While these locations can be predetermined and then established in the design of the lug 36, there may be times when adjustability in their location would be welcome. To that end, the structure illustrated in FIGS. 10, 11, and 12 has been provided. As there shown, the lug 36 has a cylindrical cavity 50 to receive a pair of telescoped cylinders 51 and 52, the former being of a size to fit the cavity 50.

The bore of the larger cylinder 51 is stepped to provide an inner small diameter portion 53 in which the "hot" bi-metal thermostat 33 is located, and a larger diameter portion 54 in which the cylinder 52 is received. The "cold" thermostat 34 is located in the bore of the cylinder 52.

The small diameter bore portion 53 of the cylinder 51 and the bore of the smaller cylinder 52 have shoulders 51' and 52' respectively projecting radially inward therefrom and facing in circumferentially opposite directions. These shoulders correspond to the previously identified shoulders 39-39', but since the cylinders 51 and 52 are rotatable with respect to one another and the lug 36, the circumferential locations of the shoulders 51' and 52' can be adjusted to meet different conditions.

By interengaging axially separable serrations 55 on the contiguous surfaces of the cylinders 51 and 52, and serrations 56 in the side wall of the cavity 50 and in the periphery of the cylinder 51, the cylinders can be secured in any desired rotational relationship, both with respect to one another and with respect to the cylindrical cavity 50 in the lug 36. Obviously, any other way of providing rotatably adjustable splined connections between the cylinders and the cavity can be substituted for the serrations 55 and 56.

As in the preferred embodiment of the invention, a washer 40 is interposed between the two bi-metal elements and a Welsh plug 41 holds the parts assembled.

From the foregoing description taken with the accompanying drawings, it will be apparent that this invention provides a thermostatically governed control device of general utility, but especially well adapted for small engines, because of its simple, compact, tamperproof construction, and its capability of reliably affording choke control under a wide range of ambient temperatures.

Those skilled in the art will appreciate that the invention can be embodied in forms other than as herein disclosed for purposes of illustration.

The invention is defined by the following claims:

We claim:

1. A thermostatic device of the type comprising bimetal strip means having a higher coefficient of expansion at one face thereof than at an opposite face and which flexes in curling and uncurling directions in response to changing temperature, and a member which is movable between defined limits relative to fixed structure and which should be at one of said limits when the bimetal strip means is subjected to temperatures in a first range thereof and should be at its other limit when the bimetal strip means is subjected to temperatures in a second and substantially different range thereof, so that each of said limits corresponds to one of said temperature ranges, said thermostatic device being characterized by:

A. said bimetal strip means comprising a pair of bimetal strips, one for each of said temperature ranges;

B. cooperating means on one end of each bimetal strip and on the movable member providing a connection by which flexing of the bimetal strip in one of its directions is translated into a force upon the movable member that tends to maintain it at its limit corresponding to the temperature range for the bimetal strip;

C. cooperating means on the other end of each bimetal strip and on the fixed structure providing a connection for receiving the reaction to force that the bimetal strip exerts upon the movable member;

D. one of said connections for each bimetal strip being a unidirectional connection operative to enable said bimetal strip to exert force upon the movable member only in the direction to urge the movable member towards its limit that corresponds to the temperature range for that bimetal strip and being ineffective to transfer force between the bimetal strip and the member in the opposite direction; and E. each bimetal strip having a direction of flexure in response to temperature change which is such that its unidirectional connection is operative only at temperatures within its range and is ineffective at temperatures within the range for the other bimetal strip.

2. A thermostatic device responsive to substantially widely vary temperatures and of the type comprising bimetal strip means coiled to flex in winding and unwinding directions in response to changing temperature, and relatively fixed and movable members between which said bimetal strip means can react in its temperature responsive flexing, said movable member being confined to rotation between defined limits relative to said fixed member and being intended to be maintained at one of its said limits when the bimetal strip means is subjected to temperatures in a first range thereof and at the other of its said limits when the bimetal strip means is subjected to temperatures in another and substantially different range thereof, so that each of said limits corresponds to one of said temperature ranges, said thermostatic device being characterized by:

A. said bimetal strip means comprising a pair of bimetal strips, one for each of said temperature ranges, each spirally coiled;

B. one of said members having a cavity therein that defines a pair of coaxial cylindrical wells, in each of which one of said bimetal strips is received;

C. the other of said members having a portion which projects substantially coaxially into said cavity and which is attached to an inner convolution of each of said bimetal strips;

D. cooperating means on each of the bimetal strips, on an outer convolution thereof, and on said one member, in each of the cylindrical wells therein, defining a unidirectional force receiving connection for each bimetal strip which is operative to receive force when the bimetal strip flexes in one of its directions, so that the bimetal strip can then react between said members and impose torque upon the rotational member, but which is ineffective to receive force when said bimetal strip flexes in the other of its directions; and e. the direction of flexure in each bimetal strip with temperature change being so related to that of the other and to the direction in which force is received by its unidirectional connection that each bimetal strip exerts torque upon the rotatable member when subjected to temperatures within its range but not when subjected to temperatures within the range for the other bimetal strip.

3. The thermostatic device of claim 2, further characterized by:

F. a washer in said cavity, surrounding said other member and interposed between the bimetal strips to prevent interference between them

4. A control device wherein an imbalance between opposing forces acting on a movable control element urge the same in one or the other of two opposite directions with respect to a fixed element, depending upon the sense of the imbalance, characterized by:

A. a pair of thermostatic governor means to govern the response of said control element to the opposing forces acting thereon, said pair of thermostatic governor means having responses of opposite sense to a change in ambient temperature; and B. means operatively interposing said governor means between said control element and said fixed element in a manner such that each of the two governor means can govern response of said control element to the opposing forces acting thereon independently of the other, whereby the two governor means can coact to govern the response of said control element to the opposing forces acting thereon, over a wide temperature range without objectionably stressing either one of them.

5. The control device of claim 4, wherein each of said thermostatic governor means has spaced apart portions between which the thermostatic governor means exerts a force in one direction in response to changes in ambient temperature, said forces, by virtue of the aforesaid responses of opposite sense, acting in one direction at one of the governor means and in the opposite direction at the other governor means, and wherein the means operatively interposing the governor means between said movable control element and said fixed element comprises:

A. means forming a motion transmitting connection between one of said portions of each of said thermostatic governor means and one of said elements; and B. means forming a unidirectional force receiving connection between the other element and the other portion of each of said thermostatic governor means, said unidirectional force receiving connections facing in opposite directions, so that one of them receives the force that is exerted between the spaced apart portions of the thermostatic governor means in response to changes in ambient temperatures, while the other receives the corresponding force in the other thermostatic governor means, whereby one of said thermostatic governor means can govern response of said control element to the opposing forces acting thereon when the ambient temperature is within a defined low range and the other can do so when the ambient temperature is within a defined high range.

6. The control device of claim 5, wherein each of said thermostatic governor means is a bi-metal strip and said spaced apart portions are the ends thereof, wherein the means operatively interposing the governor means between said movable control element and said fixed element provides for relative movement between the ends of the bi-metal strips by the force exerted in said strips in response to changes in ambient temperature, one of said bi-metal strips being longer than the other so that the change in the distance between the ends of the long strip is more per degree of ambient temperature change then it is between the ends of the short bi-metal strip, and wherein said bi-metal strips are so oriented with respect to one another and said unidirectional force receiving connections that the long bi-metal strip governs response of the control element to the opposing forces acting thereon when the ambient temperature is in the low range and the short bi-metal strip governs response of the control element to said opposing forces when the ambient temperature is in the high range.

7. The control device of claim 6, wherein said control element is a shaft constrained to rotation so that the opposite directions in which the governor means permit it to be moved by an imbalance between the opposing forces acting thereon are rotary, wherein said bi-metal strips are spiral coils encircling said shaft, wherein it is in the inner end portion of each coiled bi-metal strip that is connected to the shaft, and wherein said means forming the unidirectional force receiving connections comprise outwardly directed projections on the outer ends of the spiral coils and oppositely facing shoulders on the fixed element positioned to be engageable by said outwardly directed projections.

8. The control device of claim 7, characterized by:

a cavity in the fixed element into which said shaft projects, said cavity having side walls, wherein said shoulders are at the side walls of said cavity, wherein said spiral coils are received in said cavity, wherein the outer convolutions of the spiral coils extend across said shoulders, and further characterized by:

means enabling the locations of said shoulders to be adjusted circumferentially of the outer convolutions of the spiral coils.

9. The control device of claim 8, wherein said cavity in said fixed element is cylindrical and has a pair of telescoped large and small external diameter cylinders received therein, the bore of each of said cylinders containing one of said spiral coils, the coil of greater length being in the bore of the small external diameter cylinder, and wherein said means enabling the locations of said shoulders to be adjusted comprises interengageable axially separable rotation preventing means on the contiguous cylindrical surfaces of the telescoped cylinders and on the side wall of the cylindrical cavity and the outer cylindrical surface of the larger diameter one of said cylinders.

10. In a control device responsive to changes in ambient temperature, having fixed structure and a control member which is confined to movement in opposite directions relative to said fixed structure, means for positioning said control member within one portion of a range of motion thereof in accordance with changes in ambient temperature within a substantially low range of ambient temperatures and in another portion of its range of motion in accordance with changes in ambient temperature within a substantially higher range of ambient temperatures, said means including:

A. a pair of thermostatic elements disposed to be responsive to changes in ambient temperature and each having a pair of spaced apart portions between which the thermostatic element exerts a force that changes with changing ambient temperature, 1. one of said elements being a high temperature thermostatic element that exerts an increasing force between its said portions in response to increasing ambient temperature,
2. the other of said elements being a low temperature thermostatic element that exerts an increasing force between its said portions in response to decreasing ambient temperature; and B. connecting means for each thermostatic element, arranged to enable the thermostatic element to react between the fixed structure and the control member, the connecting means for each thermostatic element being independent of that for the other, 1. the connecting means for the low temperature thermostatic element being so arranged that force exerted between said portions thereof in response to changes in ambient temperature in the low range thereof tends to move the control member in one direction without interference from the high temperature thermostatic element, and
2. the connecting means for the high temperature thermostatic element being so arranged that force exerted between said portions thereof in response to changes in ambient temperature within the higher range thereof tends to move the control member in the opposite direction without interference from the low temperature thermostatic element.

* * * * *